US010154718B2

(12) United States Patent
Salciarini et al.

(10) Patent No.: US 10,154,718 B2
(45) Date of Patent: Dec. 18, 2018

(54) COSMETIC POT COMPRISING A LID HAVING A TILTING COUPLING MEMBER

(71) Applicant: CHANEL PARFUMS BEAUTE, Neuilly-sur-Seine (FR)

(72) Inventors: Christian Salciarini, Hyeres (FR); Julien Chandelier, Longjumeau (FR); Gregory Perbal, Verrieres le Buisson (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 129 days.

(21) Appl. No.: 15/516,155

(22) PCT Filed: Oct. 2, 2015

(86) PCT No.: PCT/FR2015/052649

§ 371 (c)(1),
(2) Date: Mar. 31, 2017

(87) PCT Pub. No.: WO2016/051110

PCT Pub. Date: Apr. 7, 2016

(65) Prior Publication Data

US 2017/0303661 A1 Oct. 26, 2017

(30) Foreign Application Priority Data

Oct. 3, 2014 (FR) ..... 14 59482

(51) Int. Cl.

| | |
|---|---|
| ***B65D 55/04*** | (2006.01) |
| ***A45D 40/00*** | (2006.01) |
| ***A45D 40/22*** | (2006.01) |
| ***B65D 43/02*** | (2006.01) |
| ***B65D 45/16*** | (2006.01) |
| *B65D 55/12* | (2006.01) |

(52) U.S. Cl.

CPC ..... *A45D 40/0068* (2013.01); *A45D 40/222* (2013.01); *B65D 43/0231* (2013.01); *B65D 45/16* (2013.01); *B65D 2543/00537* (2013.01)

(58) Field of Classification Search

CPC ..... A45D 40/0068; A45D 40/222; B65D 43/0231; B65D 45/16; B65D 2543/00537

USPC ..... 220/259.3, 323; 215/43, 219, 223

See application file for complete search history.

(56) References Cited

U.S. PATENT DOCUMENTS

| | | | | |
|---|---|---|---|---|
| 7,677,393 | B2 * | 3/2010 | Burns | E05B 17/0041 206/710 |
| 2002/0134784 | A1 * | 9/2002 | Hsieh | H01L 21/67373 220/323 |
| 2003/0132232 | A1 * | 7/2003 | Eggum | H01L 21/67373 220/323 |

(Continued)

FOREIGN PATENT DOCUMENTS

FR 2 969 127 A1 6/2012

*Primary Examiner* — J. Gregory Pickett
*Assistant Examiner* — Niki M Eloshway
(74) *Attorney, Agent, or Firm* — Greenblum & Bernstein, P.L.C.

(57) ABSTRACT

The present invention relates to a pot for a cosmetic product, the pot being opened by rotating a lid thereby bringing about a relative rotation between a cover and a mounting plate forming the lid, and thereby causing the pivoting of coupling elements which, in a closed position of the pot, are engaged in at least one cutout formed in a neck of a base of the pot.

11 Claims, 10 Drawing Sheets

(56) References Cited

U.S. PATENT DOCUMENTS

| | | | | |
|---|---|---|---|---|
| 2004/0067091 | A1 | 4/2004 | Tsutsumi | |
| 2013/0092691 | A1 | 4/2013 | Akinori et al. | |
| 2013/0334230 | A1 | 12/2013 | Delage et al. | |
| 2014/0103043 | A1* | 4/2014 | Lonsway | B65D 1/0246 220/255 |
| 2017/0127797 | A1* | 5/2017 | Salciarini | A45D 40/0068 |
| 2018/0132592 | A1* | 5/2018 | Chung | A45D 33/006 |
| 2018/0242712 | A1* | 8/2018 | Salciarini | A45D 40/0068 |

* cited by examiner

Fig.5
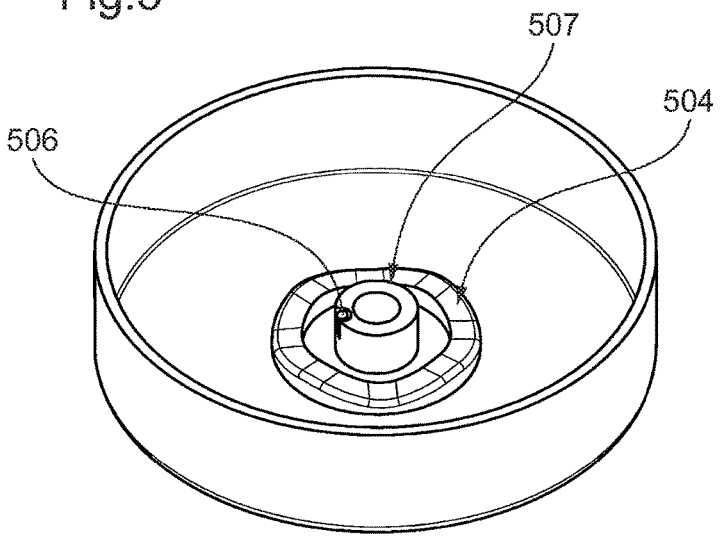
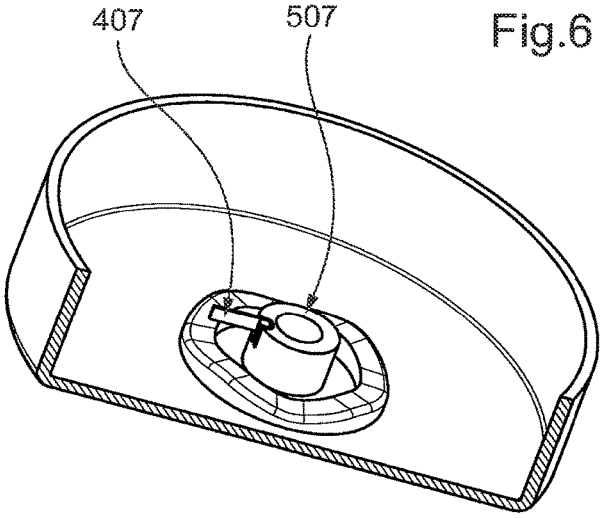
Fig.6

COSMETIC POT COMPRISING A LID HAVING A TILTING COUPLING MEMBER

BACKGROUND

1. Field of the Invention

The present application concerns the field of pots, and in particular cosmetics pots.

2. Description of the Background

Conventionally, a pot for a cosmetic product comprises a base, generally of glass or of plastic, that is to say a container surmounted by a neck of which size of the diameter is in the vicinity of cross-section dimensions of the base, to have a wide opening. The base is closed by a lid, generally screwed onto the neck. The lid is furthermore generally equipped with a seal having the role of providing sealing for closing for good preservation of the product contained.

However, a drawback lies in the fact that the thread of the screw thread formation present on the neck requires there to be a neck clear from the rest of the base over a certain height and also a lid of a relatively great height. In other words, the presence of the screw thread formation imposes constraints in terms of dimensions for the height of the neck and the thickness of the lid.

Moreover, in particular for a round pot that has no stop for screwing, a user who closes the pot has difficulty determining when the tightening of the lid on the base is right. Excessive tightening over time induces crushing of the seal. Insufficient tightening means that the seal does not provide proper sealing. In both cases, the air can enter the pot or volatile products of the formula, that is to say of the product contained in the pot, can escape from the pot, such that a risk arises of the formula degrading over time.

For a pot of non-circular shape of which the base and the lid have identical contours, the pot often has a stop that limits the angular travel of the lid in relation to the base so as always to have coinciding shape between the base and the lid. The presence of the stop thus prevents over-screwing, and therefore compensates for a loss of sealing in case the seal is crushed.

The document US2004/0067091 is known for example which describes a bottle, typically for nail polish, which enables closing by clipping the cap onto the container and opening by pressing on at least one button acting on an elastic ring. A spring device furthermore enables fluid-tight closing of the bottle to be provided to avoid any spilling of the product it contains. Such a cap however has the drawback of being particularly bulky, and in particular engendering a relatively great height to house the device therein. Furthermore, such an embodiment is suitable for a bottle of which the neck has a small diameter, but could be difficult to apply to a pot of which the neck has an appreciably greater diameter.

SUMMARY

To solve at least some of the aforementioned drawbacks, the present invention is directed to providing a pot with a lid that is simple to use to close or open the pot, which enables reliability of closing to be ensured and which moreover leads to other advantages.

To that end, according to a first aspect, there is provided a cosmetic pot comprising a base and a lid to close the base, wherein:

the lid comprises an inside part, termed coupling plate, and an outside part, termed cap, the coupling plate and the cap being rotatably mounted in relation to each other, such that the lid is configured to adopt a resting position and an opening position in which the coupling plate and the cap are turned in relation to each other in relation to the resting position, the coupling plate comprising:

a support, at least one coupling member mounted on the support and tiltable in relation to it, the at least one coupling member comprising a claw, the at least one coupling member being configured to adopt at least a first position when the lid is in resting position and a second position when the lid is in opening position, the second position being a position in which the at least one coupling member is tilted in relation to the first position, and at least one coupling return member linked to the support, the at least one coupling return member being configured to bring the at least one coupling member back into the first position, and the cap comprising an axial cam, the axial cam being defined by a profile forming at least one active zone projecting in relation to a bottom of the lid, and the axial cam cooperating with the at least one coupling return member and being configured to elastically deform the at least one coupling return member driving tilting of the at least one coupling member, and the base comprises a neck provided with at least one peripheral indentation, the claw of the at least one coupling member of the lid being engaged in the at least one indentation of the neck of the base when the lid is in resting position and the pot is closed.

An "axial cam" here means a cam with axial transmission, that is to say that the translational movement it causes, and more particularly here the deformation of the at least one coupling return member, is along the same axis as the rotational axis around which it turns. This type of cam is also called an "end cam" in some fields.

According to an exemplary embodiment, the coupling member comprises a return arm.

The return arm of a coupling member is for example a part of the coupling member by which the coupling member is brought back to the first position or tilted into the second position.

The coupling return member is for example an elastically deformable member, with a bump, that is to say an apex or a protuberance, which projects, facing the return arm of the at least one coupling member, for example from below. It is for example a spring type member, for example such as a wave washer.

The indentation of the neck is configured here to form a longitudinal stop, that is to say in a vertical direction in relation to the pot, such that it is impossible to pull the lid to open the pot without turning it in order for the inside and outside parts to tilt in relation to each other to free the claw of a coupling member thus forming a hook, that is to say to say move it away from the neck so that it can be freed from the indentation.

A rotation of the cap in relation to the coupling plate induces a movement of the claw enabling it for example to disengage from the indentation formed in the neck of the base. Provided no relative rotation is applied to the inside and outside parts of the lid, the lid is in resting position, and no force is applied to its various components. Wear of the lid is thus limited.

The opening of the pot is achieved by the relative rotation of the outside cap and of the inside plate, but any relative rotation between the inside plate and the neck of the pot base is very limited or even avoided, such that a seal that may be present operates mainly in compression, minimizing shear forces, very present in the case of a screwed lid.

The seal may be made of an adherent material, that is to say with poor slipping qualities. The sealing is thereby easier to achieve with efficiency and a large choice of materials and/or embodiments is possible for producing the seal.

Furthermore, the pot is aesthetic since it is possible to dispense with the screw thread formation on the neck. The dimensional constraints on the height of the neck and the thickness of the lid imposed by the presence of a screw thread formation can thereby be avoided.

Such a lid is also aesthetic because no part of its mechanism, with the possible exception of at least one claw, is visible to a user without recourse to dismantling the lid. Such a hidden mechanism enables a lid with an elegant shape to be obtained.

The lid furthermore enables a high variability of volume, which enables different sizes to be produced, without being constrained by the bulk of the mechanism which it comprises, in particular in terms of height.

The lid is also easily adaptable to any existing pot for example and may also be re-adapted later to another pot, of the same product or having a different capacity. This for example enables the lid to be customized and to be able to keep it in course of use of different pots, whether it be a pot of the same product, or of different products, whatever their capacity.

Furthermore, in contrast to a screwed lid, the neck here is not necessarily of circular cross-section. It is possible to have a neck with any particular shape, oval, oblong, square, polygonal or other shape, provided that the lid has a matching and/or adapted shape.

Concerning the cam, a "projecting active zone" here designates the part of the cam that enables the coupling return member to be acted upon. The projecting active zone has for example the shape of a bump or segment involute to a circle. In a particular embodiment, the cam profile has a regular contour to provide a more gentle rotational movement of the coupling plate in relation to the cap, without jolts.

The cam is situated towards the center of the lid. On account of this, the torque that a user must apply between the base of the pot and the lid to induce the relative rotation of the cap in relation to the plate is small. This produces a lever arm effect between the periphery of the lid and the zone in which the cam is located. Whatever the case, the torque is lower than for a conventional screwed lid in which the torque applied by the user must overcome the friction forces between the lid and the neck which are localized at the periphery of the lid.

The at least one coupling member in the second position is thus tilted in relation to the first position. Such a movement induced by the cam makes it possible to better ensure easy opening of the pot in use of the lid.

Thus, at least by the effect of friction, the coupling plate is held orientated on the neck when the cap is turned until the at least one claw disengages from the indentation of the neck.

The pot is thus hermetically closed and can be opened by a simple and rapid manipulation, in particular because such a lid enables the pot to be opened with a movement potentially less than or equal to a quarter turn (90°), or even approximately 45° in a particular embodiment, or even less for example such as approximately 15° or approximately 10°.

Once open, the pot is easily closed again by clipping of the lid. In other words, the pot is closed simply by replacing the lid and pressing on the lid in order for the coupling member to pass the rim of the neck and engage under the rim, in an indentation.

According to an advantageous arrangement, the lid comprises a position return member, the position return member being linked to the support of the coupling plate and furthermore being linked to the cap, the position return member being in a configuration referred to as "neutral" when the lid is in resting position and in a deformed configuration when the lid is in opening position, the position return member inducing a counter-rotation of the cap in relation to the coupling plate when the lid is in opening position so as to bring the lid automatically back into resting position.

Such a position return member cooperates with the cam to facilitate the return to resting position of the lid. More particularly, according to an exemplary embodiment, the cam is configured in order for the resting position to be a position of stable equilibrium of the upper part in relation to the lower part, whereas the opening position is an unstable position such that the lid naturally tends to return to resting position in which the mechanical forces of the various components of the lid are minimum. The presence of a position return member enables this aspect to be reinforced to promote the lid always returning to resting position.

According to a convenient exemplary embodiment, the position return member is a blade. The blade is for example held in a slot formed in the support of the coupling plate and also held in a slot formed in the cap. For example, the slot of the coupling plate and the slot of the cap are configured such that the position return member is in a natural position, that is to say not deformed, when the lid is in resting position. The position return member also acts as a rotation travel limiter between the cap and the coupling plate of the lid.

Such a position return member is thus particularly easy to produce and to assemble with the other components of the lid.

According to an advantageous exemplary embodiment, the axial cam has an annular shape.

Such a cam thus makes it possible, for example, to elastically deform the at least one coupling return member, in particular if the latter comprises at least one wave washer, more homogeneously.

It is furthermore easier to produce and to integrate into a cap of which the various components are generally of circular or cylindrical shape for example.

For example, in resting position, the profile of the axial cam then espouse the profile of the wave washer, and during pivoting of the cap, the axial cam deforms the wave washer more homogeneously.

Furthermore, such a cam is particularly convenient with a coupling member configured such that its claw engages in an indentation formed in an outside periphery of the neck, which makes it possible to avoid contact of the claw with the product contained in the pot, and thus ensure better hygiene.

According to a particularly advantageous example, the at least one projecting active zone of the axial cam has a plane of symmetry such that the cap and the coupling plate of the lid are configured to turn in relation to each other in a clockwise or anticlockwise direction, in the same manner.

Such a lid thus enables a manipulation equally easy for a left-handed user or a right-handed user, by enabling the inside part to be turned in relation to the outside part in the same manner in one direction or the other.

According to a particularly advantageous exemplary embodiment, the lid comprises at least two tiltable coupling members each comprising a claw, each coupling member being configured to adopt a first position when the lid is in resting position and a second position when the lid is in opening position, the second position of each coupling member being a position in which each coupling member is tilted in relation to the first position, the claw of each coupling member of the lid being engaged in the at least one indentation of the neck of the base when the lid is in resting position and the pot is closed.

According to an exemplary embodiment, each coupling member also comprises a return arm.

Similarly, the return arm of each coupling member is for example a part of the corresponding coupling member by which the coupling member is brought back to the first position or tilted into the second position.

Generally, each coupling member comprises a claw and a return arm. All the coupling members, when the lid has at least two of them, can be identical in a particular embodiment.

According to an exemplary embodiment, the at least one coupling return member is of annular shape and has at least one bump, the at least one projecting active zone of the axial cam cooperating with the at least one bump of the at least one coupling return member when the lid is in opening position.

According to an exemplary embodiment, the coupling return member comprises for example a bump under each of the return arms of the coupling members and the cam has for example the same number of projecting active zones as there are bumps in the coupling return member so as to be able to simultaneously tilt all the coupling members.

However, the coupling members are independent. This independence enables a better adaptation to any type of base. In other words, this enables greater tolerance; the lid can better adapt to a base neck in order to maintain sealing, for example by always enabling compression of the seal.

Furthermore, each projecting active zone for example has a same height for each angle of rotation of the lid in relation to the coupling plate and each bump of the coupling return member has a same height for each angle of rotation of the cap in relation to the coupling plate such that for a given angle of rotation, each corresponding coupling member is simultaneously tilted through a same angle. This makes it possible to produce a clearly defined and an easy opening of the pot when the lid is used.

The projecting active zones, like the coupling members, are disposed with regular spacing in relation to each other according to a particular embodiment. Thus, in a case in which the lid comprises two coupling members and two projecting active zones on the cam, these are diametrically opposite, for example. Or, in a case in which the lid comprises four coupling members and four projecting active zones on the cam, these are disposed every 90°, for example. The same applies for the coupling return member.

However, their respective dispositions may be irregular if the shape of the lid or of the pot for which it is provided so requires, provided that each coupling member is synchronized with a projecting active zone of the axial cam and a bump of the coupling return member.

According to particularly convenient arrangements, when the lid comprises at least two coupling members and at least two corresponding projecting active zones on the cam, the lid comprises a single coupling return member configured to bring back each of the at least two coupling members automatically to the first position.

The presence of a single coupling return member better enables the synchronization of movement of each of the coupling members to be ensured. It furthermore facilitates the production of the lid by minimizing its number of components.

In a non-limiting embodiment, the at least one coupling return member comprises at least one first wave washer having at least one bump.

A wave washer is for example of polymer or metal. Such a coupling return member is for example disposed between the support of the coupling plate and the return arm of each coupling member. Thus, when the lid is in opening position, the coupling return member is deformed and as a reaction tends to return the coupling members into their first position, and so return the lid into resting position.

In another non-limiting embodiment, the at least one coupling return member comprises the first wave washer and at least one second wave washer, the second wave washer comprising at least one bump and at least one trough, and the first wave washer and the second wave washer being assembled to each other with the at least one bump of the first wave washer in face-to-face relationship with the at least one trough of the second wave washer such that the first wave washer and the second wave washer are positioned in opposition.

The presence of several washers for example makes it possible to amplify the spring effect.

Furthermore, the at least one indentation of the base neck is possibly continuous or discontinuous.

For example, the base comprises at least one rib configured to keep the coupling plate of the lid oriented in relation to the base when the at least one coupling member is in first position with the lid on the base.

In a case of a pot with a circular contour in which the neck is also circular, rotational indexing of the lid in relation to pot base is generally not necessary. The indentation may then be continuous and thus form a channel all around the neck. The at least one coupling member may then engage in the indentation, which is then single, at any location.

However, for example if the pot has a non-circular contour and, for example, involving position indexing of the lid in relation to the base (even if the neck is circular), the indentation is then possibly discontinuous. That is to say, the neck then for example comprises at least one rib, that is to say one or more rib(s), to serve as an orientation stop. Such a rib is thus suitable to limit the rotation of the lid in relation to the base. Thus, when the lid is turned in relation to the base to open the pot, the at least one rib locks its rotation and thus forces the cap to pivot in relation to the coupling plate. The at least one rib may also facilitate the positioning of the lid in relation to the base in the case for example in which the base and the lid must comply with a certain alignment in relation to each other. On closing, after having engaged the lid on the neck in order for the coupling members to enter the at least one indentation, the user then continues the rotation of the lid until the resistance is felt that is caused by the meeting of a coupling member with a rib. On releasing the cap, this is returned into its resting position which places it in the appropriate position in relation to the base. It may be noted that in the case of a single rib, there is however only one indentation even though this is then discontinuous. It is then for example possible for several coupling members to engage in the same indentation.

Thus, the base may comprise several indentations and several ribs if necessary, for example as many indentations as coupling members, the indentations being separated from each other by ribs.

According to a possible exemplary embodiment, each rib is flush with a peripheral rim of the neck, such that a coupling member in second position then simultaneously has the capacity to pass over a rib and the peripheral rim to disengage from its indentation.

According to another possible exemplary embodiment, each rib is set back in relation to a peripheral rim of the neck. In this case, the at least one coupling member possibly engages initially under the peripheral rim, facing a rib, then afterwards, while the lid is turned, more deeply into an indentation.

According to an advantageous embodiment, the width of each of the indentations is adjusted to receive a claw of a coupling member with an amount of play reduced to the operating play. In other words, the at least one indentation has a width substantially equal to a width of the claw of the corresponding coupling member. The "width" here designates the dimension along the circumference of the neck. With such an embodiment, the lid is positioned on the base in a limited number of angular positions, for example one position or four positions considering a case in which the neck would comprise four indentations. The four positions enable the lid to be positioned to coincide with the faces of the pot if this is square for example. A single position would correspond to the case in which the pot base and the lid would have a cross-section of asymmetrical or arbitrary shape and in which a single angular position of the lid on the pot would enable coinciding shape between the pot base and the lid. Furthermore, the neck may have a circular cross-section as mentioned above or else a cross-section corresponding to the cross-section of the base. Thus, for example for a pot of square general cross-section, the neck possibly has a substantially square shape. In this case, the indentations are formed towards the middle of each of the sides of the square, for example.

BRIEF DESCRIPTION OF THE DRAWINGS

The invention, according to an exemplary embodiment, will be well understood and its advantages will be clearer on reading the following detailed description, given by way of illustrative example that is in no way limiting, with reference to the accompanying drawings in which:

FIG. 5 presents a perspective view of the inside of a cap of the lid of FIG. 1 according to a second embodiment of the present invention;

FIG. 6 presents a view in perspective and in partial cross-section of the inside of the cap of FIG. 5;

DETAILED DESCRIPTION

Identical parts represented in the aforementioned figures are identified by identical numerical references.

The present description is mainly given with reference to a pot of round contour but it would of course be valid for a pot of square or arbitrary contour.

Figure 1:
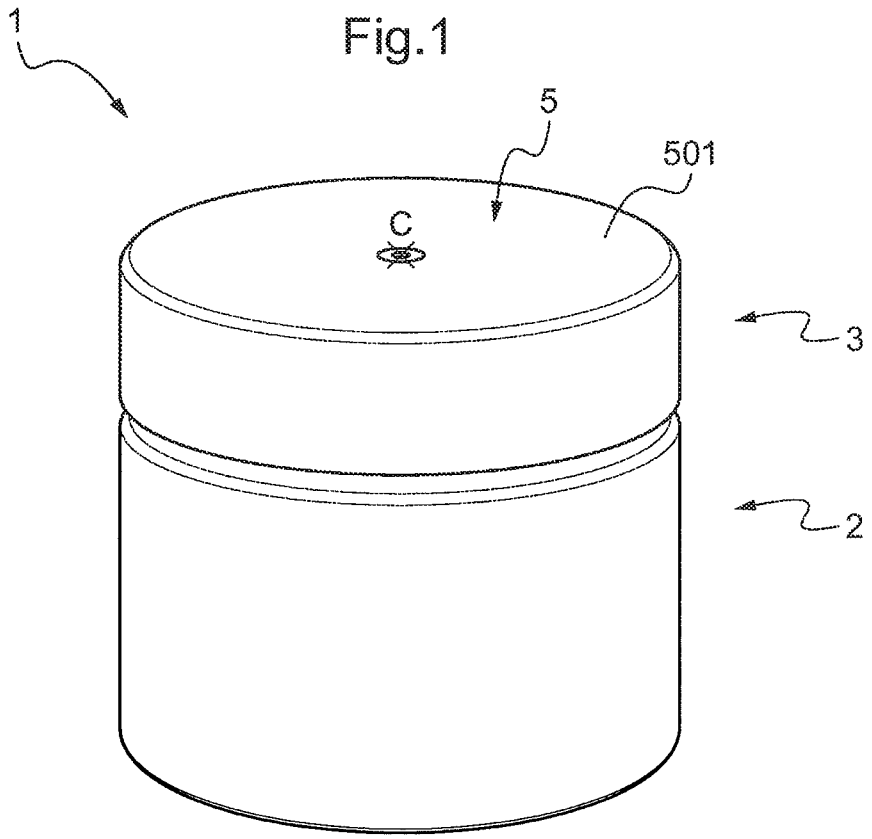
FIG. 1 shows a perspective view of an exemplary embodiment of a cosmetics pot with a circular contour and which comprises a base and a lid.
Figure 13:
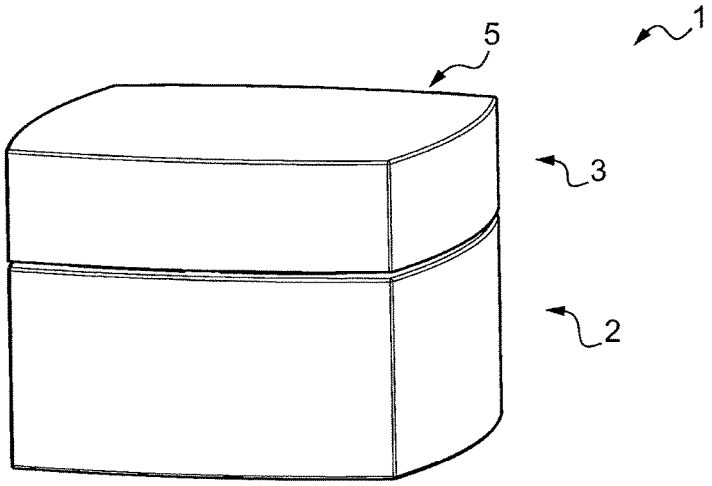
FIGS. 13 and 14 present in perspective view a pot of square contour and with a square neck according to another exemplary embodiment of the present invention, respectively closed and open.
Figure 14:
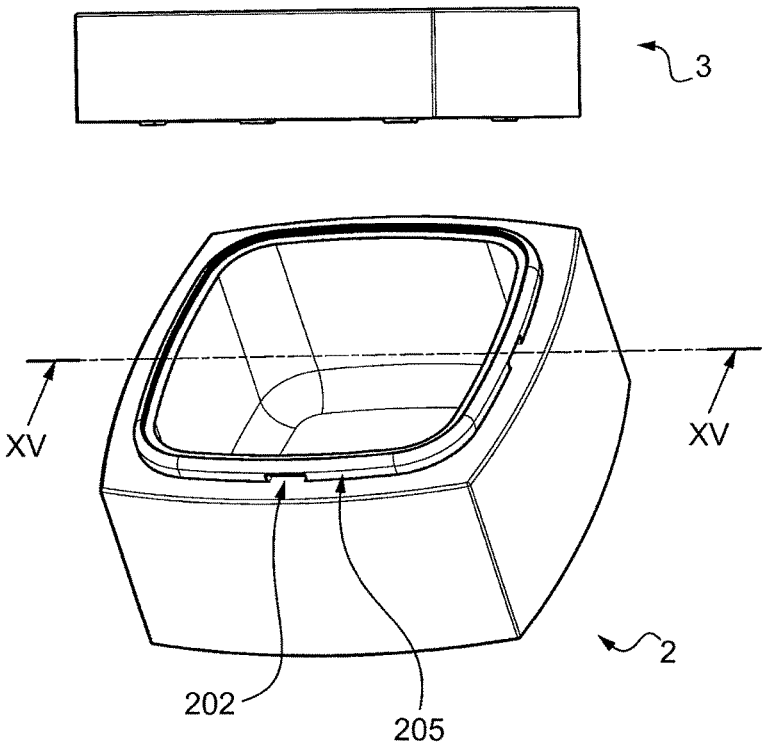

As a matter of fact, traditionally, a cosmetic pot 1 has a contour that is round like that represented in FIG. 1, or often substantially square, as in FIGS. 13 and 14.

The pot 1 comprises a base 2 and a lid 3 enabling the pot 1 to be opened or closed.

Figure 2A:
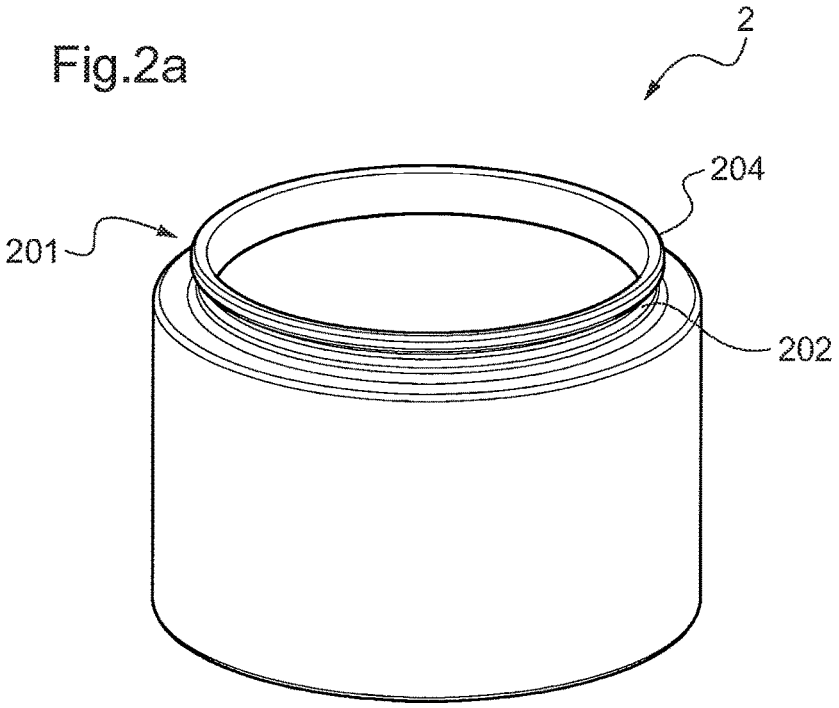
FIGS. 2*a* and 2*b* present the base of the pot of FIG. 1 respectively in perspective and elevation view.
Figure 2B:
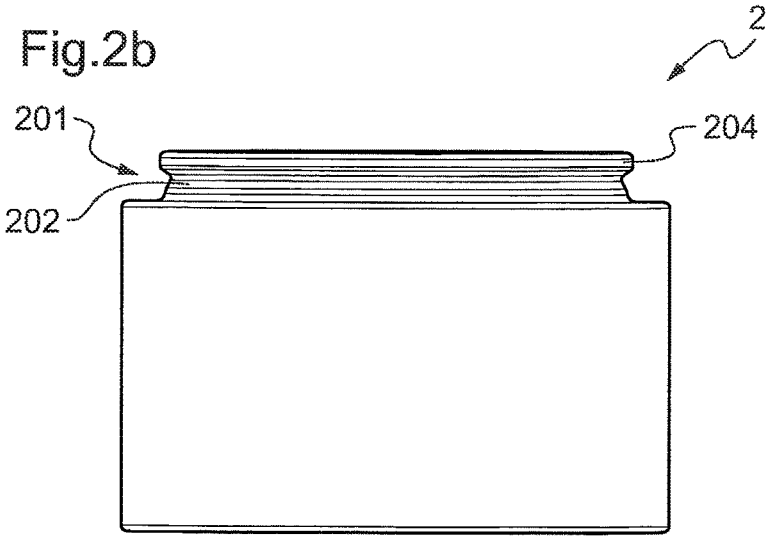

The base 2 is for example represented individually in FIGS. 2*a* and 2*b*. It comprises a container 200 and a neck 201 that surmounts the container 200. The neck defines an opening that enables access to a product contained in the container 200. The dimensions of the neck and of the opening are in the vicinity of the cross-section dimensions of the base. Whatever the case, the opening of the pot is sufficiently wide to enable the passage of at least one finger of one hand, that is to say that it has a transverse cross-section dimension greater than or equal to approximately 25 millimeters.

The neck 201 here comprises one indentation 202 and one peripheral rim 204. In non-limiting embodiments, an upper part of the rim 204 is rounded or beveled to create a ramp effect if a member is moved vertically against the neck. Furthermore, the lower part of the rim is also rounded, which has an effect on a linking force between a claw of a coupling member (represented for example in FIG. 9) and the neck, this is described in more detail below. In this exemplary embodiment, the neck 201 has a circular section, but it may be otherwise according to the shape of the pot. The neck 201 thus possibly lacks any screw thread or screw ramp and, compared to a conventional neck, it has a lower height. For example, by way of example, a round pot according to the invention can have a height of 57 mm with a neck of 6.4 mm height, and with an indentation of 4 mm height, and 2 mm depth. For a conventional pot of the same size, the height of the neck would have been of the order of 10.3 mm. These values are however given only by way of example.

The base is formed of any appropriate material, in particular glass or plastics material. It may be transparent or opaque. It may be provided to receive a mounted-on tub which contains the cosmetic product as in the case of a conventional pot.

In a pot according to the invention, the lid 3 is clasped onto the base 2, using claws.

Figure 3:
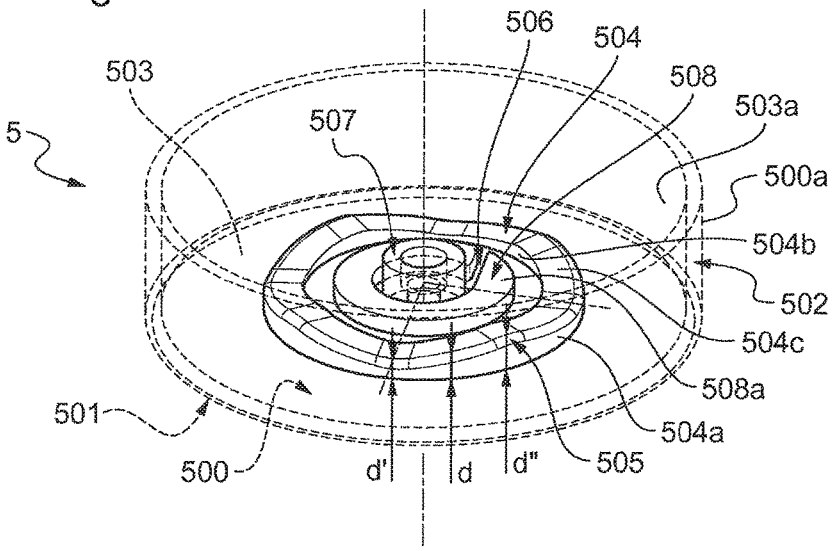
FIG. 3 presents a perspective view of the inside of a cap of the lid of FIG. 1 according to a first embodiment of the present invention.
Figure 4:
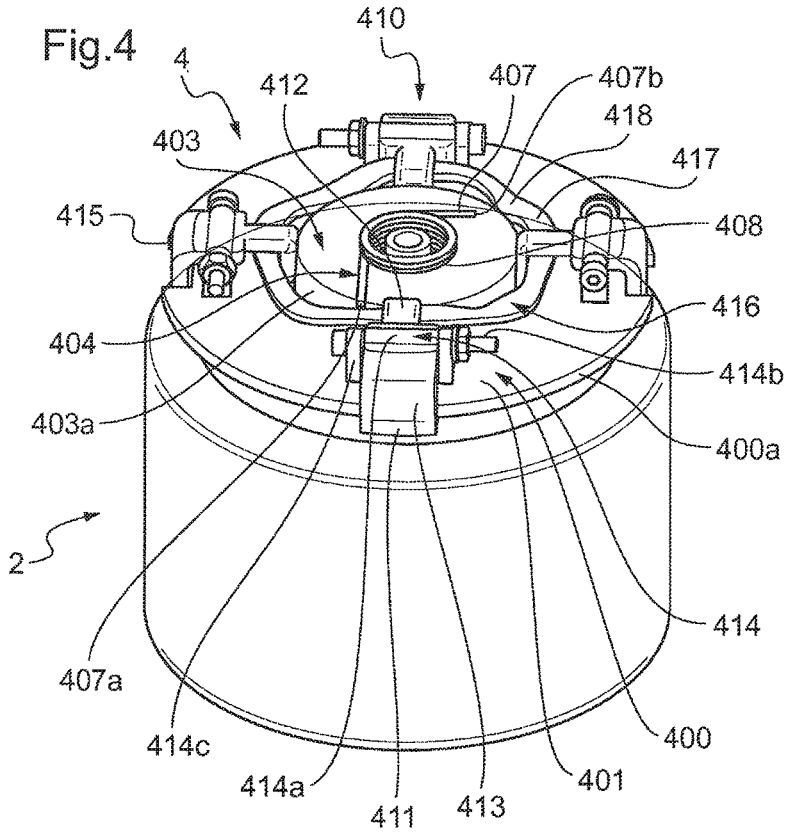
FIG. 4 presents a perspective view of a coupling plate of the lid of FIG. 1 according to a first embodiment of the present invention fastened onto the base of FIG. 1.

For this, the lid 3 comprises a cap 5, represented in FIG. 3 according to an exemplary embodiment of the present invention, and a coupling plate 4, represented in FIG. 4 according to an exemplary embodiment of the present invention.

The cap 5 and the coupling plate 4 cooperate to enable easy opening and reliable closing of the pot 1 in use.

The cap 5, as represented for example in FIG. 3, comprises a body 500. The body 500 comprises an upper face 501 (visible in FIG. 1), a bottom 503, at the back of the upper face 501, and a contour wall 502.

The upper face 501 here constitutes an outside face, provided for example to be visible to a user when the pot 1 is closed. The upper face 501 is for example customizable, in the sense that it is configured to receive decoration, for example in the form of varnish. According to an option not shown, the upper face is formed by one or more additional layers of openwork that are superposed in order to constitute the decoration, or for instance by an additional layer of marquetry. It may be produced from plastic, wood, glass or other materials. The upper face 501 is for example planar or domed.

The contour wall 502 extends from adjacent the bottom 503.

The contour wall 502 comprises an outside contour surface 500*a*, which advantageously has the same shape as the base 2, and an inside contour surface 503*a*.

Furthermore, the outside contour surface 500*a* is positioned at the periphery of the upper face 501; it is tangential to an edge of the upper face 501.

In a non-limiting embodiment, bottom 503 is substantially at a right angle to the inside contour surface 503*a* and outside contour surface 500*a*. Likewise, the inside contour surface 503*a* is of circular shape, that is to say it forms a cylinder with a diameter substantially equal to the diameter of a support 400 of the coupling plate 4, which described below, such that the cap 5 can pivot in relation to the coupling plate 4.

Independently of the shape of the outside contour surface 500*a* of the cap 5, the inside contour surface 503*a* can be centered in relation to the cap 5, in a particular embodiment. In other words, here, a central axis of the cylinder representing the inside contour surface 503*a* can be coextensive with a geometric center C of the cap 5 (illustrated in FIG. 1).

The cap 5 comprises, at its center, adjacent the bottom 503, a cylindrical part 507. The cylindrical part 507 serves here to define the rotation between the cap 5 and the coupling plate 4.

On the bottom 503, around the central cylindrical part 507, the cap 5 comprises a relief of increased thickness forming a stud 508. The stud 508 is of annular shape here, and has a bearing surface 508*a*, here planar and substantially parallel to the bottom 503 of the cap 5.

The cap 5 furthermore comprises a slot 506. The slot 506 is configured to receive a position return member 407, described below and which can for example be seen in FIG. 4.

The slot 506 is hollowed into the relief of increased thickness forming the stud 508, and is open on opposite sides of the stud 508.

Thus, adjacent the bottom 503, the cap 5 further comprises an axial cam 504. The axial cam 504 is formed here by a relief of increased thickness of variable height in relation to the bottom 503 of the cap 5. The axial cam 504 is of annular shape here, centered here in relation to the geometric center C of the cap 5, with a bearing face 504*c*, which thus constitutes an active part of the cam, an outside contour surface 504*a* and an inside contour surface 504*b*, for example parallel to the inside contour surface 504*a*. In the present exemplary embodiment, the axial cam 504 surrounds the slot 506.

In the present exemplary embodiment, the bearing face 504*c* defines a profile forming at least one projecting active zone 505. Here, it forms four projecting active zones 505, one projecting active zone 505 per coupling member 410.

Here each projecting active zone 505 is defined by an angular portion of the axial cam 504 between two successive positions in which a height of the cam, for example here between the bearing face 504*c* and the bottom 503 of the cap 5, is equal here to a distance d' which is minimal. In other words, a projecting active zone presents a height d between the bearing face 504*a* and the bottom 503 of the cap 5 which is greater than the minimum distance d' and which successively increases and decreases along the angular portion up to at least one position from which the height d begins to increase again.

In general, and in the non-limiting illustrated embodiment, the heights of the axial cam are defined in relation to a surface serving as a bearing surface between the cap 5 and the coupling plate 4. In the present exemplary embodiment, it is for example the bearing surface 508*a* of the stud 508. However, as the bearing surface 508*a* is substantially parallel to the bottom 503 here, the heights of the axial cam may thus be interchangeably defined in relation to the bearing face 508*a* or the bottom 503.

In the present exemplary embodiment, the axial cam 504 has four positions at the height d between the bearing face 504*c* and the bottom 503 of the cap 5 is minimum, furthermore equal here to the height d', which makes it possible to define a trough between two consecutive projecting active zones 505. Between two consecutive troughs, the height d between the bearing face 504*c* and the bottom 503 of the cap 5 is greater and up to a maximum height d" and enables a peak of a projecting active zone 505 to be defined. Each projecting active zone 505 thus has a peak which corresponds to a position where the height between the bearing face 504*c* and the bottom 503 of the cap 5 is maximum and thus has the value d". In the non-limiting illustrated embodiment, the height d between the bearing face 504*c* and the bottom 503 of the cap 5 changes in the same way on respective opposite sides of the peak of a projecting active zone 505 until it reaches a position of distance d' in relation to the bottom 503, that is to say a trough. In other words, each projecting active zone 505 comprises a plane of symmetry. The axial cam 504 for example here has eight planes of symmetry.

The coupling plate 4, represented for example in FIG. 4, comprises a support 400 here formed by a circular plate. Whatever the outside shape of the pot 1, the support 400, in the illustrated embodiment, has a circular contour 400*a* in order to facilitate rotation in relation to the cap 5. Thus, the support 400 here has the general shape of a disk.

The support 400 for example comprises at least one cut-out 415, and here four cut-outs 415 which are each adapted to receive a coupling member 410. Furthermore, the four cut-outs 415 are positioned here at equal distances from each other along the contour 400*a*.

It is considered here that the support 400 comprises an upper face 401 adapted to be oriented towards the cap 5, and a lower face 402 (visible in FIG. 11), parallel to the upper face 401, adapted to be oriented towards the base 2.

The coupling plate 4 possibly further comprises an obturator plate 419, visible in FIGS. 8 or 10, secured below the support 400, that is to say adjacent the lower face 402.

The support 400 is formed of any appropriate material, typically plastic, by molding, with the upper face 401 and the lower face 402 generally being planar.

The lower face 402, or the obturator plate 419 according to the case, is furthermore generally covered by a compressible planar seal 420, such as a membrane, having a thickness of a few tenths of a millimeter, provided to be compressed on its perimeter between the lower face 402 and the rim 204 of the neck 201 of the base 2. The planar seal is for example formed of any appropriate elastically compressible material, in particular of polyethylene, SEBS, elastomer or any other equivalent material. As there is very little or no relative rotation between the coupling plate and the neck, the planar seal is not acted on, or is very little acted on, in shear, and it is possible to choose a relatively adherent material which has a high coefficient of friction.

Instead of such a compressible planar seal an obturator plate mounted on a suspension and adorned with a seal of reduced thickness may be envisioned, as is described for example in patent application FR 2969127.

On the same side as the upper face 401, the support 400 here comprises a central stud 403 formed in relief in relation to the upper face 401. The central stud 403 is of generally cylindrical shape, such that an outside contour surface 403*a* of the central stud 403 is substantially parallel to the contour 400*a* of the support 400. In other words, the central stud 403 is centered on the upper face 401of the support 400.

The central stud 403 here comprises a slot 404 and, furthermore, a bore 408 such that the central stud 403 is thus of annular shape. The slot 404 is of constant width here and passes through the central stud 403 from the bore 408 to reach the outside contour surface 403*a*. The slot 404 is provided to receive the position return member 407 serving to bring the cap 5 back into resting position in relation to the coupling plate 4 when the cap 5 is turned in relation to the coupling plate 4.

The position return member 407 of the exemplary embodiment of FIG. 4 has a first end 407*a* inserted into the slot 404 of the coupling plate 4 and a second end 407*b* inserted into the slot 506 of the cap 5 once the cap 5 and the coupling plate 4 have been assembled. Furthermore, the position return member 407 is wound helicoidally here, as a helical spring, around a central pin with its first end 407*a* and its second end 407*b* projecting and straight in order to be able to cooperate with the slots 404, 506.

Each end 407*a*, 407*b* of the position return member 407 is for example inserted into the corresponding slot 404, 506 which makes it possible to avoid recourse to other fastening or assembly means for example such as adhesive. Thus, it is as if the position return member 407 is embedded in the central stud 407 and also embedded in the stud 508, that is to say, more generally in the coupling plate 4 and also in the cap 5.

Adjacent the upper face 401, the coupling plate 4 further comprises a coupling return member 416.

The coupling return member 416 serves to bring a coupling member 410 into first position by acting as a spring as is detailed below. For this, according to this particular embodiment, it is elastically deformable. It comprises for example at least one bump.

The coupling return member 416 is disposed between the upper face 401 of the support 400 on which it rests and at least one arm 412 of a coupling member 410. It is furthermore disposed here around the central stud 403.

In this non-limiting embodiment, the coupling return member 416 is composed of a single part in order to better ensure a synchronized movement of the coupling members 410 if the lid 3 comprises at least two of them. However, the coupling member 416 could comprise several independent spring members for each of the coupling members 410 without preventing their synchronized movements.

The coupling return member 416 is for example here a washer, and more particularly a wave washer with at least one bump 417. In the case of a wave washer being used as coupling return member 416, the wave washer advantageously comprises the same number of bumps 417 as the lid 3 comprises coupling members 410 and, in this non-limiting embodiment, with identical bumps 417 to promote the synchronized movements of the coupling members 410.

As FIG. 4 shows, as the pot 1 of the present exemplary embodiment comprises four coupling members 410, the wave washer here comprises four bumps 417.

By convention, two consecutive bumps 417 define a trough 418 between them.

In the present exemplary embodiment, the wave washer 416 has an inside diameter substantially equal to the central stud 403 to limit, or even eliminate lateral translation movements of the wave washer, that is to say horizontal translations, in a plane parallel to the upper face 401. In a vertical direction, translations of the coupling return member, whatever they be, are limited because it is held between the upper face 401 and at least one coupling member 410. Lastly, a rotational movement of the coupling return member 416 around the vertical axis, that is to say around the central stud 403 in this case, may be limited by any means, for example such as a spot of adhesive, or a rivet, or for instance a local deformation of the coupling return member 416 and/or of the upper face 401, and/or for instance a local deformation of the coupling return member 416 at the location of the peak of a bump 417 such that an arm 412 maintains its orientation.

Figure 7:
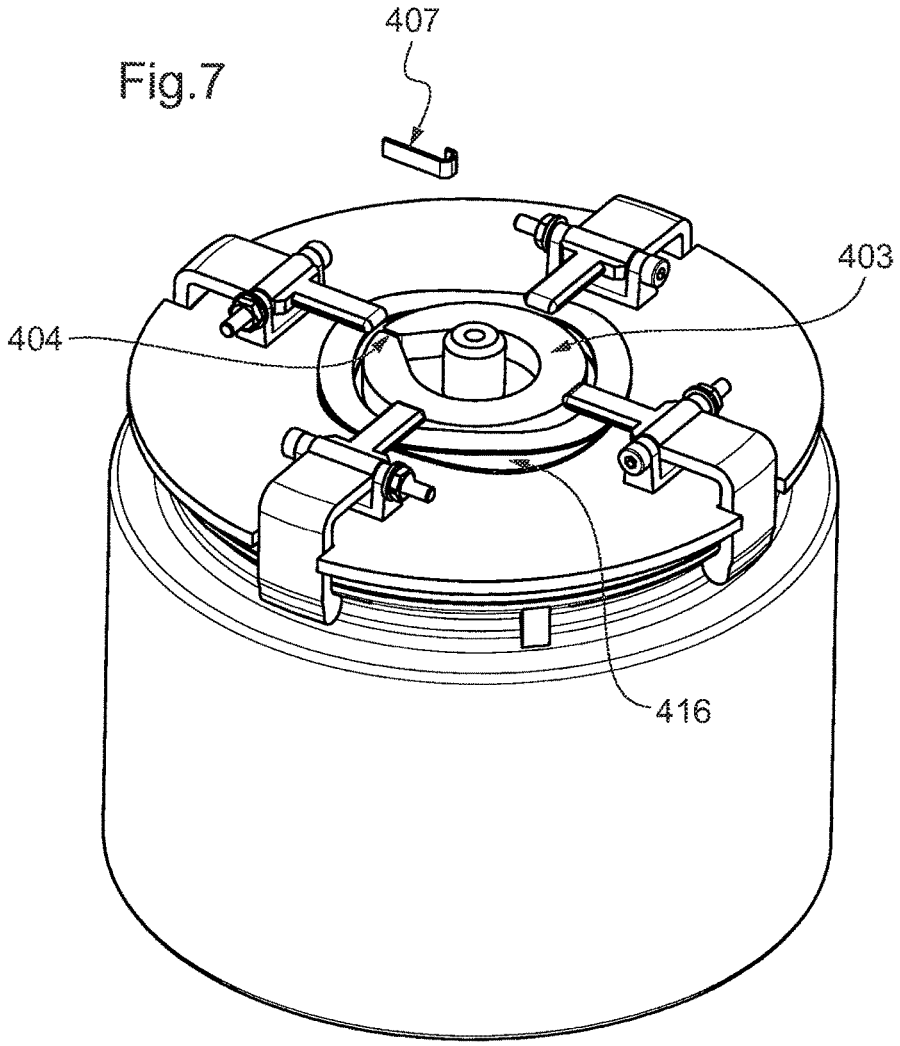
FIG. 7 presents a perspective view of a coupling plate of the lid of FIG. 1 according to a second embodiment of the present invention fastened onto the base of FIG. 1.
Figure 8:
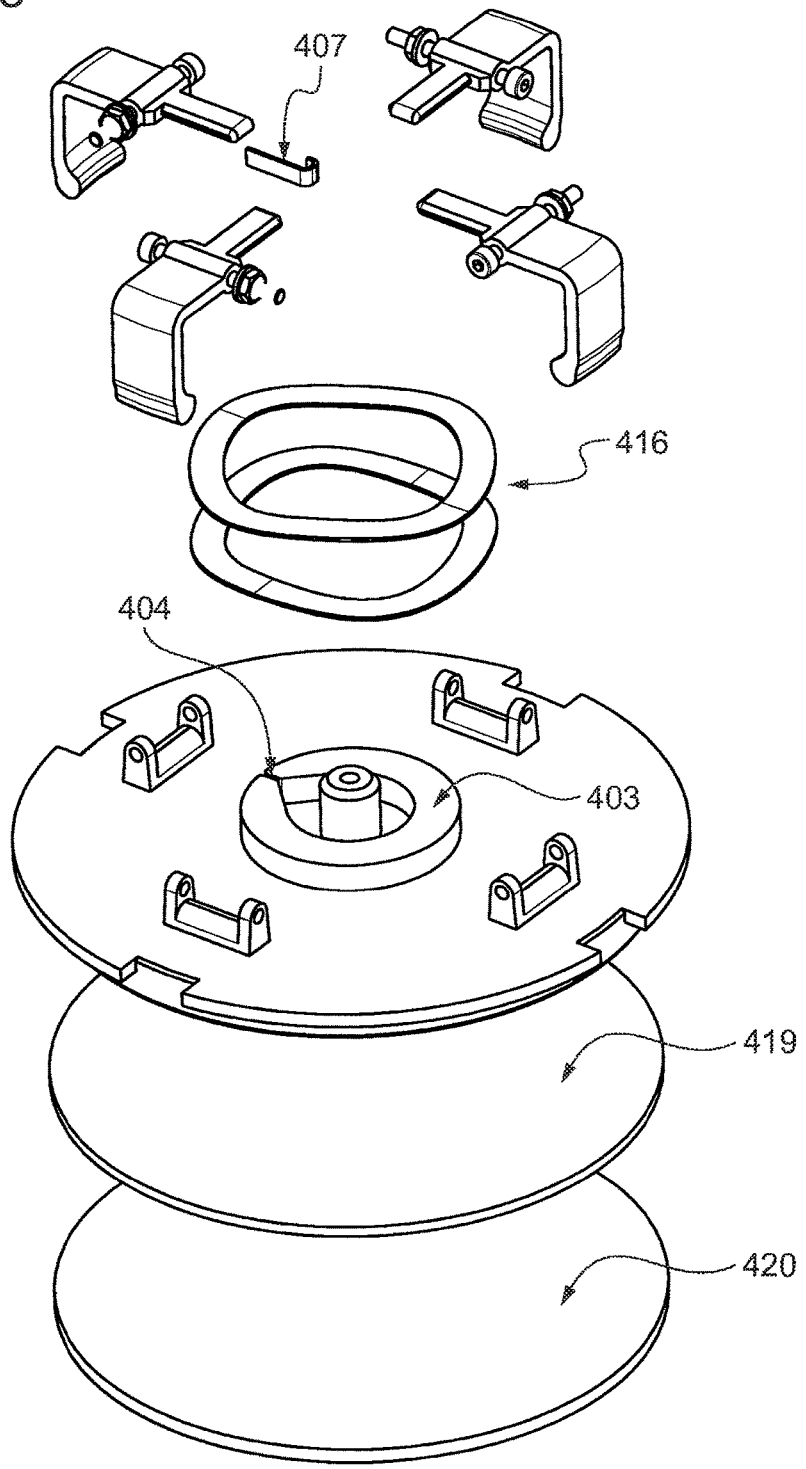
FIG. 8 presents an exploded view of the plate of FIG. 7.

According to another exemplary embodiment represented for example in FIGS. 7 and 8, the coupling return member 416 comprises two wave washers comprising the same number of bumps as each other, and therefore the same number of troughs, and are disposed one on the other such that the trough of a first wave washer faces a boss of the second wave washer. Each arm 412 of a coupling member 410 is then in contact with a bump of a first wave washer, which would be an upper wave washer, that is to say placed nearest the cap 5, and opposite a trough of a second wave washer, which would be a lower wave washer, that is to say thus in contact with the upper face 401 of the support 400. Such a superposition of wave washers thus enables the spring effect to be amplified for example.

The same would apply if the coupling return member 416 comprises more than two wave washers.

As mentioned above, to grasp the lid 3 of the base 2, the coupling plate 4 comprises at least one coupling member 410.

In the present exemplary embodiment, it comprises four identical coupling members 410, positioned at equal distances from each other, that is to say every 90°, at the periphery of the support 400, and in the cut-outs 415, since the support 400 has these. These cut-outs 415 are thus configured to hold the coupling members 410 in position around the support 400.

Each coupling member 410 is rotatable in relation to the support 400 in a direction at a right angle to the axis, referred to as vertical axis, passing through a center of the support 400.

Each coupling member 410 comprises a claw 411 and a return arm 412. In the present exemplary embodiment, the claw 411 and the return arm 412 extend from a same face of a dorsal wall 413 of the coupling member 410 while being oriented towards the center of the support 400. In other words, each return arm 412 extends along a radius of the support 400 for example. The coupling member 410 is thus C-shaped, surrounding an edge of the support 400. The return arm 412 here for example is finger-shaped, with a free end and an end linked to the dorsal wall 413.

The claw 411 is configured to grasp the neck 201 of the base 2 by engaging in the indentation 202 under the rim 204. The claw 411 here has an edge shape of a hook, curved towards the center of the support 400. In the present exemplary embodiment, the claw 411 passes under a level of the lower face 402 of the support 400, as can be seen in FIGS. 10 to 12.

Figure 9:
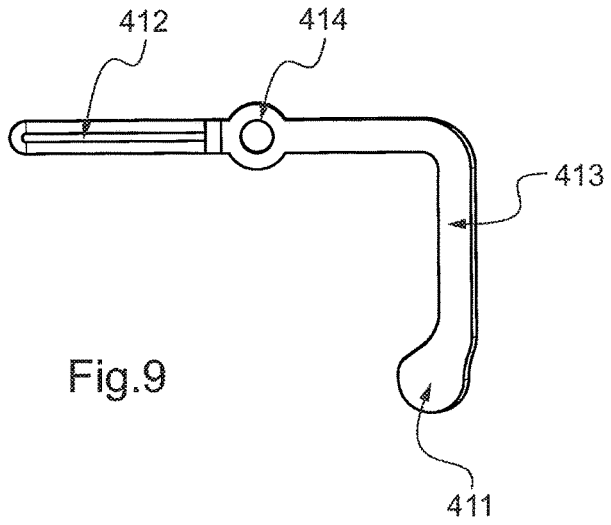
FIG. 9 presents a view in side elevation of a coupling member according to an exemplary embodiment.

As FIG. 9 shows, the claw 411 has a very rounded shape, for example matching the shape of the indentation formed at the periphery of the neck. An important effect of such a shape is that a pulling force, for example induced by a user to open the pot without turning it or by an accidental application of force, indices a tightening effect of the claw in the indentation.

That being said, the rounded shape of the claw 411 facilitates the passing of the rim 204 on its engagement in the indentation 202 when, for example, the lid is clipped on to close the pot.

Each coupling member 410, comprising a claw 411, a return arm 412 and a dorsal wall 413, can be formed as one piece, for example by molding of plastic material. Or at least, the claw 411 and the return arm 412 are assembled such that when the return arm 412 lowers, the claw 411 disengages from the indentation 202.

The return arm 412 and the dorsal wall 413 define for example a guide 414 between them to form a hinge, a pivot link with the support.

The guide 414 for example comprises a hollow tube in which passes a pin 414*b* held by at least one pillar 414*c*, which pillar 414*c* is fastened to the support 400. In the present exemplary embodiment, the coupling plate 4 comprises two pillars 414*c* for each coupling member 410.

Other embodiments for tilting assembly of the coupling member to the support may of course be envisioned.

For example, the pin 414*b* and the hollow tube 414*a* are free to rotate in relation to each other in order to allow pivoting, tilting, of the coupling member 410 in relation to the support 400. Or according to an alternative, the pin 414*b* and the hollow tube 414*a* are fastened in relation to each other and the pin 414*b* is free to rotate, around a shaft of the pin 414*b* which also forms the shaft of the guide 414, in relation to the at least one pillar 414*c*.

More specifically, to state thus that the return arm 412 lowers means that its free end lowers, that is to say approaches the upper face 401 of the support 400. As a matter of fact, by itself, each coupling member 410 can be made to be only movable to rotate around the shaft of the guide 414, without considering the variety of play from assembly which there may be.

Each coupling member 410 is thus configured to take at least a first position, for example when the lid 3 is in resting position, and a second position, for example when the lid 3 is in opening position, the second position being a position in which the at least one coupling member 410 is pivoted, tilted, in relation to the first position.

More particularly, the first position is for example a position in which the return arm 412 is in a first position referred to as high position, and in which the claw 411 is engaged in the indentation 202, and the second position is for example a position in which the return arm 412 is in a second position referred to as low position, and in which the claw 411 is disengaged from the indentation 202. The coupling member 410 thus passes from one position to the other by pivoting around the guide shaft 414.

When the support 400, at least one coupling member 410 and at least one coupling return member 416 are assembled, the return arm 412 of the at least one coupling member 410 bears on part of the coupling return member 416, and an elastic deformation of the coupling return member leads to lowering of the return arm 412 enabling the claw 411 to be disengaged from the indentation 202 of the neck 201 of the base 2.

In the case of the present exemplary embodiment in which the coupling return member 416 is a wave washer, the return arm 412 of the at least one coupling member 410 bears on a bump of the coupling return member 416. The elastic deformation of the coupling member 416 for example corresponds to compression of the wave washer, enabling the return arm 412 to be lowered.

Moreover, a force induced by the coupling return member 416 under the return arm 412 tends to raise the return arm 412. However, the latter is limited in this respect because the claw comes to bear on the bottom of the indentation or that the dorsal wall comes to bear against the contour 400*a* of the support 400, in a cut-out 415. To that end, it is advantageous for the shaft of the guide to be optionally spaced away from the contour 400*a*, towards the center. In the present case, the pillars 414*c* are away from the contour 400*a* and the dorsal wall 413 is curved here towards the guide 414.

FIGS. 5 and 6 and then FIGS. 7 and 8 present another exemplary embodiment of the cap 5 of the plate 4.

The cap 5 of FIGS. 5 and 6 differs from the preceding exemplary embodiment in that it has no stud 508, and in that the cylindrical part 507 comprises an indentation, or slot, 506 configured for insertion therein of a blade spring there serving as position return member 407. Correspondingly, the plate 4 of FIGS. 7 and 8 differs in that the slot 404 of the central stud 403 is formed along a radius of the support to receive an end of the blade spring 407 in continuity with the indentation 506 of the cylindrical part 507 of FIGS. 5 and 6. In this exemplary embodiment, the blade spring 407 is flexed when the cap 5 is pivoted in relation to the plate 4.

Furthermore, in this exemplary embodiment, the coupling return member 416 comprises two wave washers.

Figure 10:
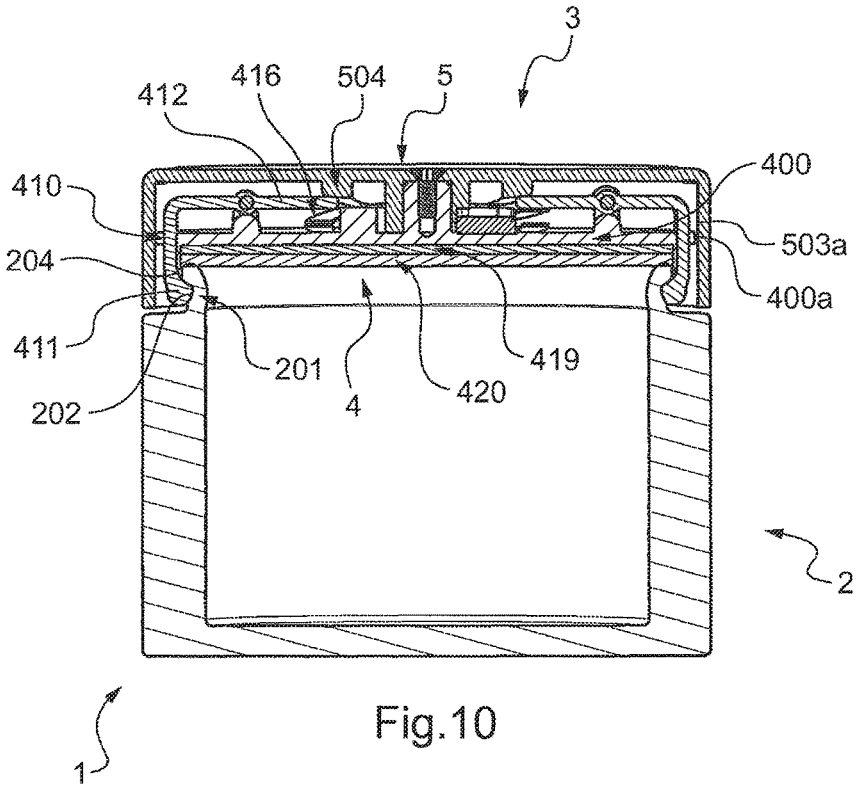
FIG. 10 presents a cross-section view of the pot of FIG. 1 according to an exemplary embodiment.
Figure 11:
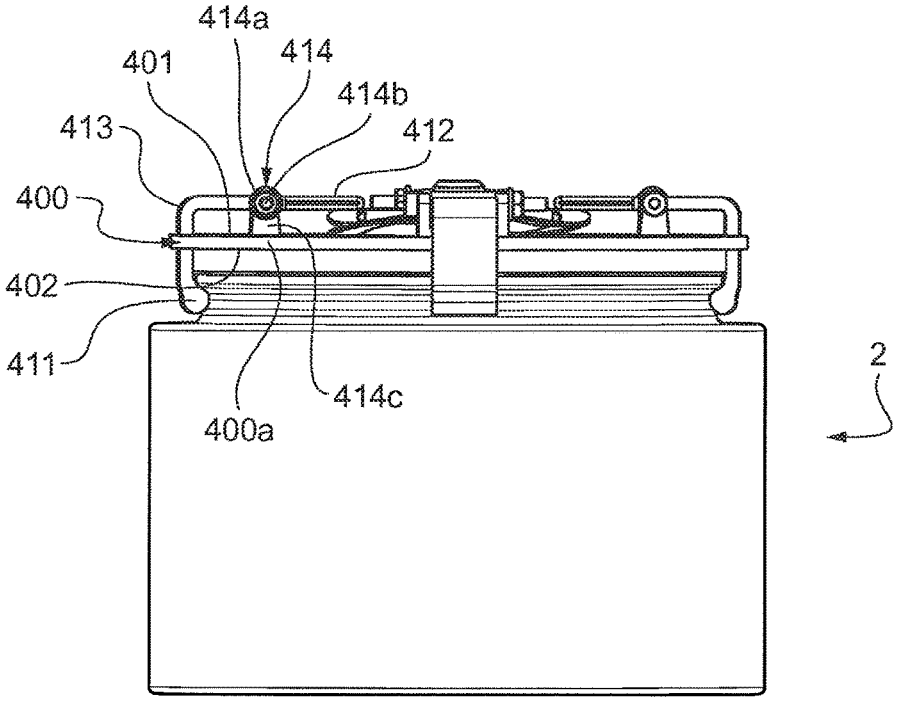
FIG. 11 illustrates an elevation view of the coupling plate in closing position.
Figure 12:
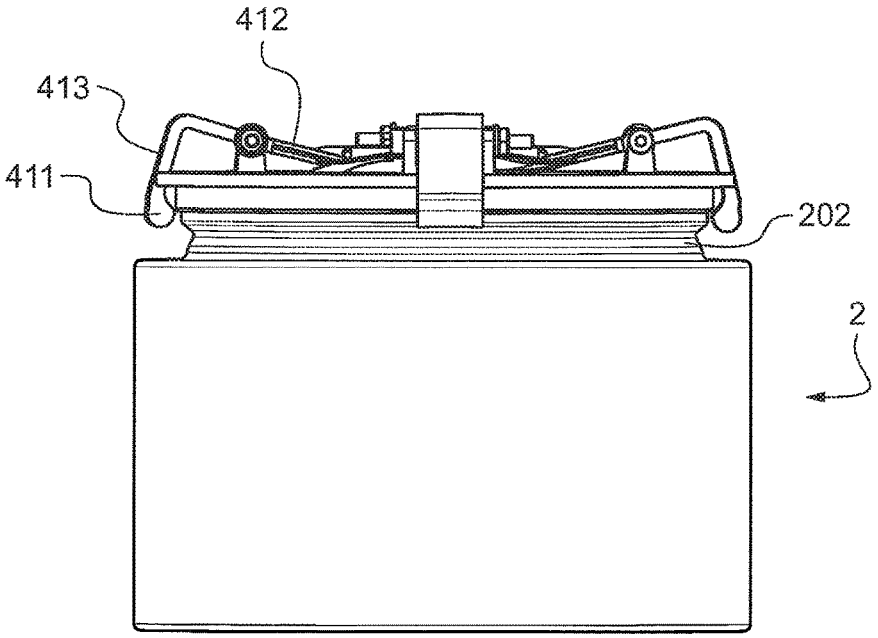
FIG. 12 illustrates an elevation view of the coupling plate in opening position.

Thus, when the cap 5 and the coupling plate 4 are assembled, the lid 3 is then configured to take a "resting" position represented for example in FIGS. 10 and 11, and an "opening" position represented for example in FIG. 12.

Thus, when the cap 5 and the coupling plate 4 are assembled, the contour 400*a* of the support 400 of the coupling plate 4 is face-to-face with the inside contour surface 503*a* of the cap 5 and the bearing face 504*c* of the cam 504 is in contact with at least the coupling return member 416. The position return member 407 is simultaneously inserted into the slot 506 of the cap 5 and the slot 404 of the plate 4 to perform its role here. Furthermore, the bearing surface 508*a* of the stud 508 of the cap 5 then bears on the central stud 403 of the plate 4 if the cap has one (this is not the case in FIG. 10).

The assembly between the cap 5 and the coupling plate 4 is achieved by any appropriate means, for example by a circlips that retains the coupling plate 4 inside the cap 5, or for instance by snap engagement of the coupling plate 4 in the cap 5. Another possibility which may be envisioned is also that the cap 5 be screwed to the plate 4, as FIG. 10 shows.

In resting position, the at least one claw 411 is engaged in the indentation 202. The cap 5 and the coupling plate 4 are oriented in relation to each other such that at least one projecting active zone 505 of the axial cam 504 is arranged in relation to the at least one coupling return member 416 such that the return arm 412 of each coupling member 410 is in high position. In other words, the at least one projecting active zone 505 of the axial cam 504 does not cause deformation of the at least one coupling return member 416, or at least insufficient deformation to move a claw 411 away from the indentation 202. The coupling return member 416 as well as the position return member 407, serving to bring the cap 5 automatically back in relation to the coupling plate 4 into a resting position orientation, are then in a natural, neutral, configuration, of minimum deformation. In the case represented in FIG. 10 in which the coupling return member 416 comprises two wave washers, each peak of projecting active zone 505 of the axial cam 504 is then face-to-face with a trough 418 of the upper wave washer and opposite a bump of the lower washer. In FIG. 4, on which the cap is not shown, the coupling return member 416 comprises a single wave washer, each peak of a projecting active zone 505 of the axial cam 504 would then be face-to-face with a trough 418 of the wave washer.

Opening the pot 1 consists in tuning the lid 3 in relation to the base 2. Pivoting the lid 3 here engenders pivoting of the cap 5 in relation to the coupling plate 4, which results in tilting each coupling member 410 and thus in clearing each claw 411 from the indentation 202, here by moving each claw 411 away from the neck 201. As soon as each return arm 412 has been lowered a predetermined amount, corresponding to a predetermined angle of rotation of the cap 5 in relation to the coupling plate 4, each claw can then pass around the rim 204.

When the rotation takes place, the at least one projecting active zone 505 bears progressively on the coupling return member 416. This induces compression of the coupling return member 416 which drives lowering of the return arm 412 which attains the low position, and thus tilting of the corresponding coupling member 410, and thus drives a moving away of the claw 411 which disengages from the indentation 202 of the neck 201 of the base 2.

Here, each projecting active zone 505 extends from a trough 418 along a bump 417 of a wave washer. Starting from a certain predetermined compression, which may be when a peak of a projecting active zone 505 reaches a peak of a bump 417 of the wave washer or before then, the tilting of an coupling member 410 is sufficient to disengage the corresponding claw 411 from the indentation 202, as is for example represented in FIG. 12.

The predetermined compression corresponds to a predetermined angle of rotation between the cap 5 and the coupling plate 4 and to a predetermined drop of the return arm 412. In the present exemplary embodiments, a peak of a projecting active zone 505 reaches a peak of a bump 417 of the wave washer for a rotation of the cap 5 through approximately 45° in relation to the resting position. Thus, for a predetermined compression which may be less, the angle of rotation would be comprised between 0° and 45° for example. Thus, the predetermined compression may be fixed so as to have to apply a rotation of 40°, or even 30°, or for instance 15° to the cap 5 in relation to the coupling plate 4 for example. The rotation of the cap 5 in relation to the plate 4 is all the more facilitated by the adherence of the seal on the neck of the base 2 which contributes to maintaining the plate 4 oriented on the base 2. Each coupling member 410 then has a tilting movement, that is to say that the free end of the return arm 412 is lowered, by a corresponding amount, and the claw 411 moves away from the indentation 202.

In parallel, the position return member 407 is deformed because it is held both in the slot 404 of the coupling plate 4 and the slot 506 of the cap 5.

Thus, to attain this opening position, the coupling plate 4 can be braked, or even retained, rotationally, or else by mere friction or adherence in relation to the neck 201.

This may however be reinforced by one of the claws 411 being in abutment on a rib 205 of the indentation 202, which can be seen for example in FIG. 14.

By convenience where provided, the rib can be of a thickness substantially equal to a depth of the indentation 202 in relation to the rim 204 such that a claw 411 is incapable of passing over the rib so long as it is unable to disengage from under the rim 204.

For example, as represented in FIG. 14, the base 2 comprises four ribs such that each claw 411 of the lid 3 described above bears against a rib whatever the direction of rotation of the lid. In this last configuration, two consecutive ribs are for example spaced away from each other by a distance equal to a width of a claw in order for the latter to be angularly locked in each direction.

According to another example, the base comprises at least one rib which extends along a circumference of the neck over a distance equal to a spacing defined between two coupling members or two sides of a same coupling member such that the coupling plate is then locked in orientation in each direction of rotation. In a case in which the lid only comprises a single claw 411, the indentation 202 could for example be defined on the neck 201 by a recess in which the claw 411 engages when the lid is in resting position. In another case in which the lid comprises at least two claws 411, at least one rib extends for example between two consecutive claws 411. It is of course possible to combine these different configurations.

In opening position, as illustrated by FIG. 12, each coupling member 410 has then reached a second position which is tilted in relation to the first position, and the coupling return member 416 as well as the position return member 407 tend to bring the lid 3 automatically back to resting position. Indeed, the position return member 407 seeks to return to the natural position, inducing a contra-rotation to that applied by a user to the lid 3, and moreover the coupling return member 416 seeks to raise the return arm 412, to act against the compression applied to it, which will also tend to push back the corresponding projecting active zone 505.

In general, the position return member 407 furthermore serves to avoid turning the cap 5 in relation to the coupling plate 4 beyond a relative angle in which each peak of projecting active zone 505 would extend beyond the peak of a corresponding bump 417 of the coupling return member 416, which would result 8 again raising each return arm 412 and would make opening a pot 1 more difficult.

A pot 1 such as described above is moreover easily closed by clipping the lid 3 on the base 2 for example.

Such a lid 3 is thus easily adaptable to any base 2, provided to contain a cosmetic product, comprising a neck 201 of corresponding diameter with at least one peripheral indentation 202.

Figure 15:
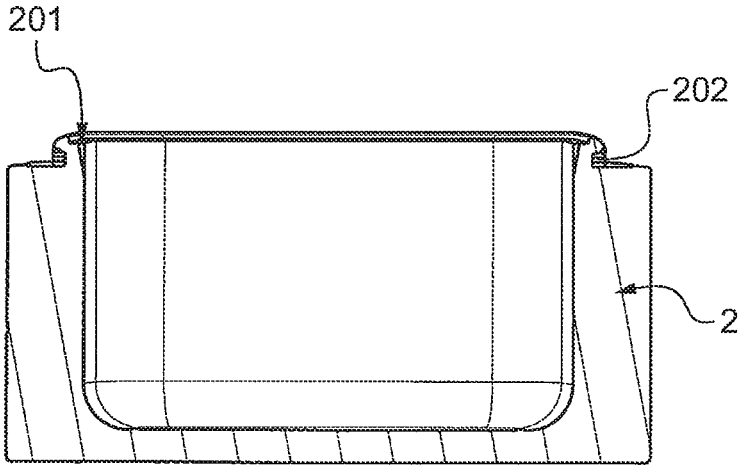
FIG. 15 presents the base of FIGS. 13 and 14 in cross-section on line XV-XV of FIG. 14.

By way of illustration, FIGS. 13 to 15 show another exemplary embodiment of a pot 1 having a square contour and an opening which is also square.

FIG. 14 in particular shows that the neck is provided with indentation 202, here formed in the middle of each side of the neck, two consecutive indentations being separated here by a rib 205, as described above.

A lid as described above is thus adaptable in the same way as for a base with a round neck to a base with a square neck.

A square neck or round neck may thus comprise one or more ribs or none. Moreover in the case of a pot of square contour, if the neck has no rib, the contour matching between the lid and the base may of course be provided by any other means.

Naturally, the present invention is limited neither to the preceding description nor to the appended drawings, but encompasses any variant form within the capability of the person skilled in the art.

The invention claimed is:

1. A cosmetic pot comprising:

a base; and a lid to close the base;

the lid comprising:

an inside part comprising a coupling plate; and an outside part comprising cap;

the coupling plate and the cap being rotatably mounted in relation to each other to configure the lid to be selectively to be movable between a resting position and an opening position, in relation to the base, in which relative rotational movement between the coupling plate and the cap moves the lid to the resting position;

the coupling plate comprising:

a support;

at least one coupling member mounted on the support and tiltable in relation to the support;

the at least one coupling member comprising a claw;

the at least one coupling member being configured to adopt at least a first position when the lid is in resting position and a second position when the lid is in opening position;

in the second position of the lid the at least one coupling member being tilted in relation to the first position; and an at least one coupling return member being configured to return the at least one coupling member to the first position; and the cap comprising an axial cam;

the axial cam being defined by a profile forming at least one active zone projecting in relation to a bottom of the lid; and the axial cam cooperating with the at least one coupling return member and being configured to elastically deform the at least one coupling return member driving the tilting of the at least one coupling member;

the base comprising a neck provided with at least one peripheral indentation; and the claw of the at least one coupling member of the lid being engaged in the at least one indentation of the neck of the base when the lid is in resting position and the pot is closed.

2. A pot according to claim 1, wherein:

the lid comprises a position return member linked to the support of the coupling plate and linked to the cap;

the position return member being in a neutral configuration when the lid is in resting position and in a deformed configuration when the lid is in opening position; and the position return member inducing a counter-rotation of the cap in relation to the coupling plate when the lid is in opening position so as to bring the lid automatically back into resting position.

3. A pot according to claim 1, wherein:

the position return member is a blade held in a slot formed in the support of the coupling plate and also held in a slot formed in the cap.

4. A pot according to claim 1, wherein:

the axial cam has an annular shape.

5. A pot according to claim 1, wherein:

the at least one projecting active zone of the axial cam has a plane of symmetry such that the cap and the coupling plate of the lid are configured to turn relative to each other in a clockwise or anticlockwise direction.

6. A pot according to claim 1, wherein:

the at least one coupling return member has an annular shape and has at least one bump; and the at least one projecting active zone of the axial cam cooperating with the at least one bump of the at least one coupling return member when the lid is in opening position.

7. A pot according to claim 1, wherein:

the at least one coupling return member comprises at least one first wave washer having at least one bump.

8. A pot according to claim 7, wherein:

the at least one coupling return member comprises the first wave washer and at least one second wave washer;

the second wave washer comprises at least one bump and at least one trough; and the first wave washer and the second wave washer are assembled to each other with the at least one bump of the first wave washer in face-to-face relationship with the at least one trough of the second wave washer such that the first wave washer and the second wave washer are positioned in opposition.

9. A pot according to claim 1, wherein:

the at least one coupling member of the coupling plate of the lid comprises at least two tiltable coupling members;

each of the at least two coupling members comprises a claw;

each coupling member is configured to adopt a first position when the lid is in resting position and a second position when the lid is in opening position;

the second position of each coupling member is a position in which each coupling member is tilted in relation to the first position; and the claw of each coupling member of the lid is engaged in the at least one indentation of the neck of the base when the lid is in resting position and the pot is closed.

10. A pot according to claim 9, wherein:

the lid comprises a single coupling return member configured to return each of the at least two coupling members automatically to the first position.

11. A pot according to claim 1, wherein:

the base comprises at least one rib configured to keep the coupling plate of the lid oriented in relation to the base when the at least one coupling member is in first position, with the lid on the base.

* * * * *